United States Patent [19]

Foley

[11] Patent Number: 4,827,735

[45] Date of Patent: May 9, 1989

[54] OFF PEAK STORAGE DEVICE

[75] Inventor: William D. Foley, Norwell, Mass.

[73] Assignee: Off-Peak Devices, Inc., Boston, Mass.

[21] Appl. No.: 178,576

[22] Filed: Apr. 7, 1988

[51] Int. Cl.[4] ..... F25D 11/00

[52] U.S. Cl. ..... 62/430; 62/59; 62/260; 62/434

[58] Field of Search ..... 62/59, 260, 430, 434

[56] References Cited

U.S. PATENT DOCUMENTS

| | | | |
|---|---|---|---|
| 1,963,698 | 6/1934 | Garre, Jr. | 62/434 X |
| 2,292,692 | 8/1942 | Huber | 62/434 X |
| 2,726,658 | 12/1955 | Chessey | 62/434 X |
| 3,156,101 | 11/1964 | McGuffey | 62/430 X |
| 3,773,031 | 11/1973 | Laing et al. | 126/400 |
| 4,011,736 | 3/1977 | Harrison | 62/435 |
| 4,134,273 | 1/1979 | Brautigam | 62/141 |
| 4,279,294 | 7/1981 | Fitzpatrick et al. | 165/45 |
| 4,283,925 | 8/1981 | Wildfeuer | 62/434 |
| 4,294,078 | 10/1981 | MacCracken | 62/59 |
| 4,346,569 | 8/1982 | Yuan | 62/260 |
| 4,393,918 | 7/1983 | Patry | 165/10 |
| 4,480,445 | 11/1984 | Goldstein | 62/434 |
| 4,513,574 | 4/1985 | Humphreys et al. | 62/59 |

*Primary Examiner*—Lloyd L. King

*Attorney, Agent, or Firm*—Lahive & Cockfield

[57] ABSTRACT

A system for ice storage provides time offset cooling to a cooling system. A tank defines a storage chamber including inlet and outlet ports through which circulates a heat transfer medium, and a plurality of buoyant panels filled with a storage medium are arranged for receiving, storing, and releasing thermal energy carried by the heat transfer medium. As the phase of the storage medium changes, flow paths past the panels are progressively occluded or widened. In a preferred embodiment, each panel is formed of a thin film material, such as a PVC plastic, with opposing sides of the panel fused together at discrete points to define a quilted bag-like structure having a defined maximum thickness and a generally undulating outer surface which allows passage of the transfer medium between adjacent bags. Granular ballast at the bottom of each bag maintains alignment and prevents thermal creeping. Bouyant spacers at the top define a self-aligning array. Time offset primary and supplemental cooling systems are described.

14 Claims, 2 Drawing Sheets

FIG. 3
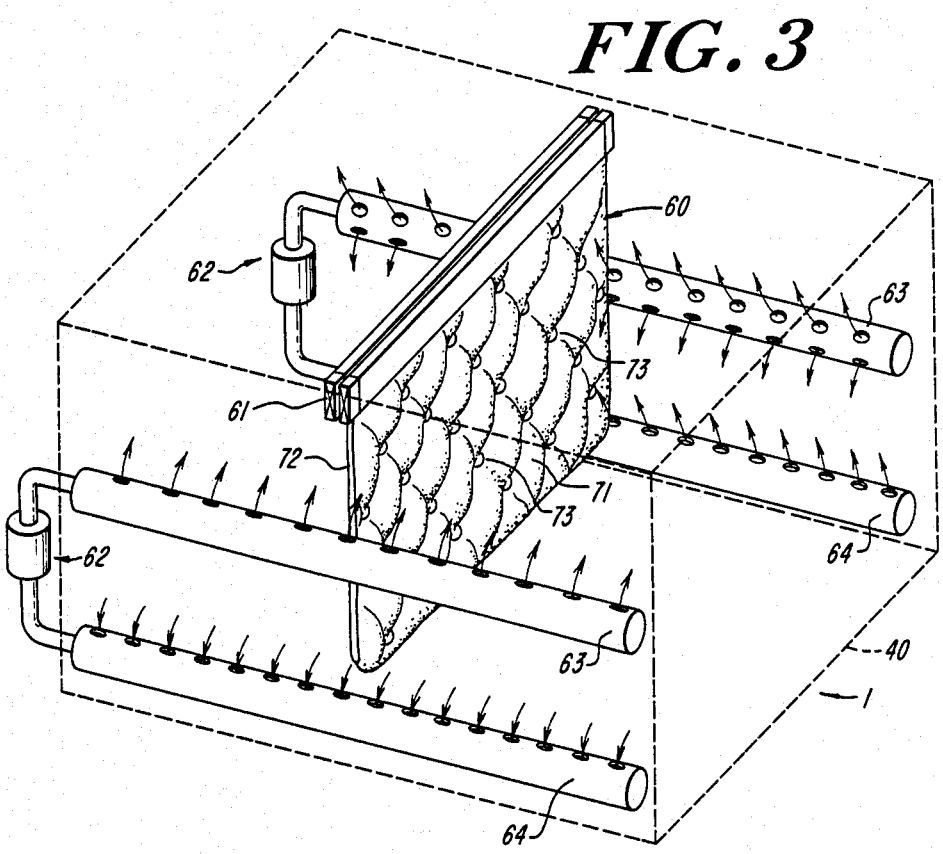
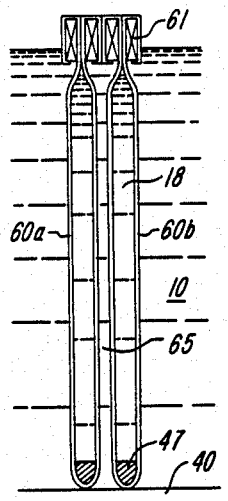
FIG. 4A
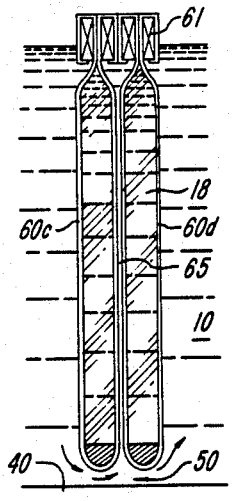
FIG. 4B
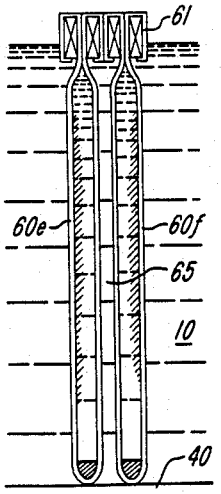
FIG. 4C

OFF PEAK STORAGE DEVICE

The present invention relates to a system for making and storing ice using the cooling system of a building or using a refrigeration system. In particular, it relates to a system of ice storage which may be used to develop cooling capacity during off peak hours, and be switched into the normal cooling or refrigeration system to replace, or to provide extra capacity for, the cooling system during hours of peak usage.

The use of buffer tanks or reservoirs for heating or cooling systems is well known. One example of such a system would be a heat storage system, such as used with solar collectors, wherein air heated in a solar panel is blown down into a gravel-filled chamber to raise the temperature of a storage mass. The storage mass is then used to maintain the temperature of air in the building by passing it through the heated gravel, heating it to an air temperature aPproximating that of the stored temperature. Along a similar principal, cold storage tanks are known wherein a heat transfer medium such as brine circulates through a tank filled with heat storage material contained within a confining structure. One example of such a system is the cold storage tank shown in U.S Pat. No. 4,011,736 of Harrison. That patent shows a cold storage tank mounted in a pit in the ground and filled with gravel. A number of containers of fresh water are held in place by the gravel, and a brine solution circulates through the gravel causing the water to freeze. The circulating brine acts as a heat transfer medium to store cold during freezing weather by forming ice, and to melt the ice during warm weather for house or other cooling purposes. Another such system for long duration earth storage of winter cold is shown in U.S. Pat. No. 4,346,569 of Yuan. That patent shows a reservoir having a number of water filled plastic bags 30 elastically suspended o therein. Another system, shown in U.S. Pat. No. 4,283,925 of Wildfeuer shows a system in which a reservoir holds a storage mass consisting of unattached capsules, each containing a storage medium having a liquid/solid phase transformation point in the temperature operating range of the transfer medium.

The described systems thus each involve a tank or chamber through which a heat exchange fluid circulates to cool a mass of cold storage material, which is generally in the form of containers of ice/water or other phase change material It will be appreciated that while a phase change enhances the amount of thermal energy stored by the material, any change in phase is generally accompanied by a change in volume. This makes the design of a physical structure for containing a sufficient quantity of such material, for maximally utilizing the volume of the tank, technically difficult. For example, if a tank were designed to contain cells of pure water occupying 95% of its volume, the 10% expansion of the water upon freezing would rupture the tank. Further, the intended cycle of freezing and thawing, with the consequent forces and motion generated thereby, makes the design of a rigid array problematic. On the other hand, if one were to dispense with a rigid structure and employ a unattached stack of storage capsules, or elastically suspended bags, the efficiency of heat transfer may vary appreciably as the material thaws and the flow paths within the tank change due to storage elements being moved around by expansive and contractile forces.

OBJECTS AND SUMMARY OF THE INVENTION

It is an object of the invention to provide a efficient cold storage system of simple construction It is another object of the invention to provide an efficient cold storage system immune to mechanical failures induced by the thermal cycling.

It is another object of the invention to provide a modular cold storage system.

These and other features of the invention are attained in a system for ice storage to provide time offset cooling to the cooling system of a building or refrigeration unit, wherein a tank defines a storage chamber including inlet and outlet ports through which circulates a heat transfer medium, and a plurality of buoyant panels are arranged in a dense array for receiving, storing, and releasing thermal energy carried by the heat transfer medium. In a preferred embodiment, each panel is formed of a thin film material, such as a PVC plastic, to result in a bag-like structure. Preferably, opposing sides of the panel are fused together at discrete points to define a quilted structure having a defined maximum thickness when filled and a generally undulating outer surface which allows passage of the transfer medium between adjacent bags while determining a well-defined thin panel geometry Granular ballast at the bottom of each bag maintains the vertical alignment of the panels and prevents the panel from rising out of the medium in its buoyant frozen state.

BRIEF DESCRIPTION OF THE DRAWINGS

These and other features of the invention will be understood in part from the following description of a preferred embodiment taken together with the drawings, wherein

FIG. 3 is a perspective view of a storage panel according to a presently preferred embodiment of the invention; and FIGS. 4(*a*)–4(*c*) illustrate flow path changes during freeze and thaw cycles of the system of FIG. 3.

DETAILED DESCRIPITON OF ILLUSTRATED EMBODIMENTS

Figure 1:
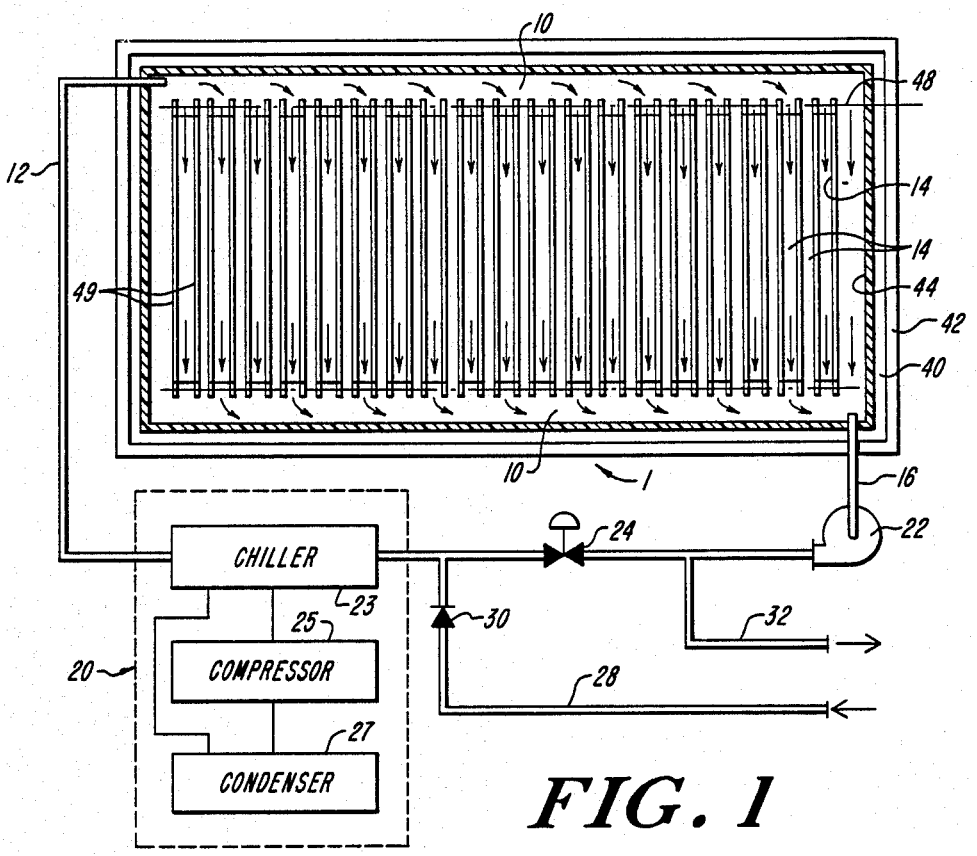
FIG. 1 shows a schematic view of a system according to the invention.

As shown in FIG. 1, the invention contemplates a modular cold storage structure 1 which receives circulating heat transfer medium denoted generally 10 through an inlet conduit 12 and engages in heat transfer between a plurality of heat storage panels 14 to either receive heat from or add heat to the circulating medium 10. The medium then passes out an exit port through an output conduit 16. Depending on the mode of operation, the heat storage module is placed in a circuit with either an external cold source to accumulate cold, or with a building or refrigeration chamber which is to be cooled by the stored energy.

As illustrated in FIG. 1, this is accomplished using a circulation pump 22 and a valve 24 which is set in a first position to provide an ice accumulating circulation loop between the storage panel 1 and a packaged chiller unit 20 of conventional type. Chiller unit 20 comprises a chiller barrel 23, a compressor 25, and a condenser 27. In this first setting, valve 24 allows direct circulation of the heat transfer medium 10 from outlet piPe 16 through the chiller unit 20, and back to inlet pipe 12, for freezing the panels in the modular storage unit. In a second mode of operation, valve 24 is closed, breaking the recirculation circuit. This changes the circulatory path to receive flow from an external supply line 28 through check valve 30 to the inlet pipe 12 of the storage unit. After passing through the storage unit, transfer medium 10 circulates via outlet pipe 16, optionally assisted by the circulation pump 22, to a second external conduit 32 which leads to the external or building system. The connections 28, 32 circulate through a secondary heat exchanger, such as a cooling tower of a building for storing additional cold, or the building air-conditioning piping system for cooling air provided to the building with the previously stored energy.

As illustrated schematically in FIG. 1, the heat exchange unit 1 includes a preferably rectangular tank 40 and surrounding wall 42 of insulating material. Tank 40 may be a concrete tank of a suitable waterproof concrete formulation, and insulation 42 may be foam slab insulation. Alternatively, or additionally, the insulating layer may be placed within the tank. In either case, the interior of tank 40 is lined with an impermeable liner 44 to assure that there is no leakage of the heat transfer medium. Liner 44 is formed of a material chemically resistant to the heat transfer medium which is, for example, an ethylene glycol and water solution, brine, or other conventional bulk transfer medium Suspended in tank 40 are a plurality of cells or panels 14 of a generally rectangular cross section which are filled with a heat storage medium, e.g., water. The cells 14 have a thickness of under two inches, and preferably of approximately three-fourths of an inch, and are arranged in a regular array to substantially fill the tank, while still permitting circulation of the transfer medium 10 therebetween. A detailed prototype design discussed further below achieves over approximately 75% utilization of the tank space for ice storage.

Figure 2:
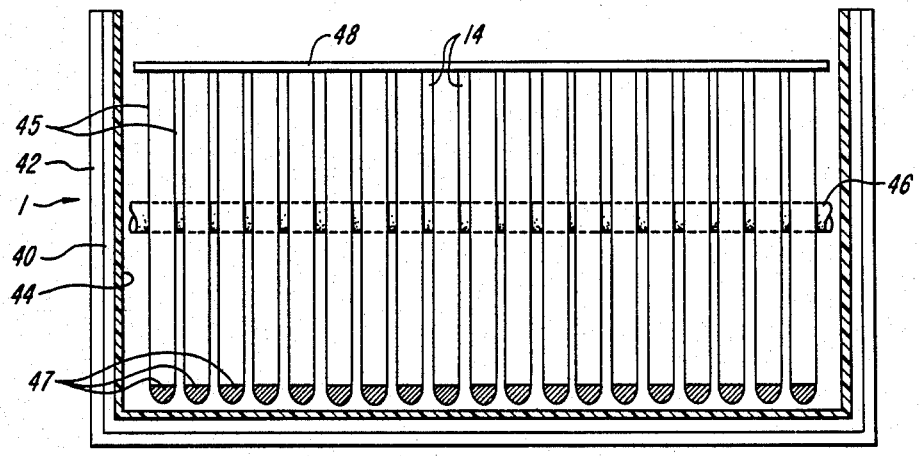
FIG. 2 shows a cross sectional view of the storage chamber and panels of storage medium according to one embodiment of the invention.

FIG. 2 shows a vertical cross section lengthwise through the tank 40 of the system 1. A plurality of thin panels 14 are suspended from a frame structure 48 at the top of the tank. For clarity of illustration, the relative width of the panels is exaggerated. Each panel 14 has ballast material 47 at its bottom end to hold the panel vertical and to counteract the buoyancy of the panel when frozen. Preferably, the panels are formed of a thin PVC film which may, for example, be as thin as one mil for smaller cells, or thicker, e.g., in the range of 4 to 12 mils for larger panels having a heights, for example, of between four and ten feet. In one prototype design of the invention, frame structure 48 is a rigid floating frame constructed of polymer pipe filled with a buoyant foam filling, which extends from one end of the tank to the other. The cells 14 are placed cross-wise along the frame in a regular array, optionally hanging from additional bouyant cross members 49 (not shown) of similar construction.

Each cell or panel 14 is a generally rectangular hanging bag structure weighted at the bottom with granular ballast 47 The weight of ballast 47 is calculated to be approximately five to ten percent of the weight of water held by a cell. Thus, for example, for a three-fourths inch thick panel ten feet high, approximately four pounds of ballast are used for each foot of panel width. Sand or lead shot are suitable ballast materials. This ballast anchors the panels in a vertical orientation and, due to its thickening effect, serves to maintain the bottoms of the panels at an appropriate spacing. Also shown in FIG. 2 is a disperser conduit 46 into which the inlet pipe feeds or the outlet pipe draws its fluid. These disperser conduits 46 consist of lengths of pipe having holes therein oriented at different angles to define a relatively broad range of flow paths past the surfaces of the panels. The disperser conduits 46 may be formed of conventional Percolation pipe, such as used in ground drainage systems.

A primary advantage of the present heat storage system is its high efficiency in the transfer of heat or cold to or from the transfer medium, and in the quantity of ice which may be formed per unit volume of the storage tank. Since the panels are relatively thin, e.g., preferably less than approximately one inch, all of the stored ice is accessible to the transfer medium across a relatively short heat transfer path, and great rates of heating or cooling are achieved, as may be required, for example, when starting up the cooling system of a Previously uncooled building. The system is further characterized in simple construction of essentially nonmechanical components. These include a reservoir, the heat storage bags and the flow dispersion piping, all of which are operated as an open flow system free of the fluid pressures characteristic of many closed conduit heat transfer or refrigeration systems. Thus, the only pressures active on the system are the hydrostatic pressures characteristic of the tank height, and the frictional or motive pressures induced by freezing and thawing. The latter thermal cycling effects are minimized by the inherent compensation of the bouyantly suspended and aligned system.

FIG. 3 shows a perspective view of a presently preferred construction of a storage panel, denoted 60, corresponding to panel 14, according to a presently preferred aspect of the invention. As illustrated therein, the storage panel 60 is formed of opposing plies 71, 72 of plastic film material which are joined together at junction points 73 spaced at regular intervals along their opposed faces to form a quilted bag which extends to a thickness of approximately one inch when filled with water. At the top of the bag structure so formed, the sheets are folded over a pair of flotation slabs 61, which in the prototype are one-half inch thick strips of styrofoam insulation material, and are bonded to the slabs so as to form a hanging envelope structure suspended from the styrofoam strips. The contiguous support slabs 61 of adjacent envelopes thus define a one-inch spacing between the center planes of successive panels, while providing a free floating suspension at the top. When the tank is entirely filled with an array of panels, the top of each panel is pushed substantially closed by the spacer strips 61, so that each cell is substantially covered, preventing evaporative losses or contamination by bacteria or mold organisms. Since the tops are freely opened, the panels are not susceptible to a build-up of pressure therein, and may initially be conveniently filled from the top by placing a measured volume of water in each panel. The flexible structure of the panels allows all panels to assume positions of substantial equilibrium, during many cycles of freezing and thawing, resulting in uniform spacing and substantially uniform flow between the panels in use.

Shown in phantom in FIG. 3 is the surrounding tank 40 wherein additional elements as follows are indicated schematically. First, an optional recirculation loop 62 is illustrated in phantom for recirculating heat transfer fluid between the top and bottom of the tank so as to avoid stratification. The recirculating loop 62 includes upper and lower dispersion pipes 63, 64 with a circulation pump 65 connected for drawing fluid in through one of the recirculation pipes 64 and propelling it out through the other pipe 63. This enhances flow within the tank so as to more quickly place the transfer fluid in equilibrium with the stored ice throughout the tank. For smaller tanks, an alternate recirculation means may comprise a number of baffles within the tank situated in relation to the inlet and outlet ports for creating current to enhance the mixing of transfer fluid within the tank. A simple impeller centrally located on the bottom of the tank to direct a constant current upward to cause the transfer fluid to circulate in flow loops within the tank may also be used. The illustrated circulation loops 62 may be equipped with additional valves and interconnections so that the pipes 63 may serve for the disperser pipes (46, FIG. 2) connected to an inlet or outlet.

FIGS. 4(*a*)–4(*c*) illustrate a further aspect of a preferred embodiment of the invention, wherein the panels of heat storage medium are arranged so that freezing of a panel affects the flow paths of the heat transfer medium within reservoir 40.

In FIG. 4(*a*) a pair of bouyant panels 60a, 60*b* are fille with a storage medium 18 and suspended from cross members 61, hanging vertically due to the weight of ballast 47, in a tank of transfer medium 10. A nominal space 65 is defined between the panels, which is less than (e.g., is 5–50 percent of) the panel thickness, and the height of medium 10 in the reservoir 40 is maintained such that the bags contact or extend down close to the reservoir floor. Transfer medium 10 is free to flow through the inter-panel spaces 65, thus contacting the broad Panel faces for efficient heat transfer.

In FIG. 4(*b*) a pair of panels 60*c*, 60*d* are shown with their enclosed storage medium 18 frozen. The phase change upon freezing results in expansion of the medium, so that the thickened panels at least partially occlude the flow path 65 between panels. The phase expansion also decreases the panel density, causing each panel to bouyantly rise, thus opening (or widening) a flow path 50 below the panels. When the panels are in the frozen state, this under-panel circulation path allows warmer transfer medium to circulate fully below the panels, so that the lighter warm transfer medium may rise of its own bouyancy under all panels, despite the closing off of lateral accessibility space 65 between adjacent panels.

Finally, in FIG. 4(*c*), panels 60*e* and 60*d* are shown in a semi-thawed state, wherein reduced panel bouyancy again causes the panels to descend, and to occlude flow path 50, causing circulation to proceed primarily across the tank in inter-panel spaces 65, to more uniformly transfer cold to or from the panels.

Thus, the panels are arranged to define sets of different flow paths and to selectively direct flow from one path to the other upon freezing or thawing of the storage medium, resulting in greater uniformity of the freezing and thawing processes.

In a system according to the present invention, the use of an ice storage tank as a thermal buffer allows the design of HVAC systems having smaller overall refrigeration unit ratings, because the non-mechanical thermal buffer can supply a fraction of the required cooling capacity which is replenished on a daily or weekly basis by operation of the system during off hours, or by replenishment of the buffer through heat exchange with a natural heat source, e.g., from the environment. Thus, the invention contemplates complete systems wherein a cooling plant is provided of a size too small for a building or refrigeration application, and wherein a thermal storage system according to the invention is operated in parallel with the cooling plant so as to achieve a rate of cooling adequate for cooling of a building during the daytime, and the thermal storage system is recharged during non-occupied hours of the building.

It will be appreciated that while the invention has been described with regard to the illustrated embodiment and certain presently preferred constructions, such description is by way of illustration and is not intended to limit the scope of the invention. Thus, particular dimensions of representative panel constructions may vary, including panels of different heights and thicknesses and panels formed of differing materials than those described herein. In systems embodying the invention different configurations of conduits, valves and other elements may be employed for placing the thermal storage unit in series or parallel with a mechanical chilling system, and diverse modes of operation and other embodiments are contemplated.

The invention being thus disclosed and described, other variations and modifications will occur to those skilled in the art, and these variations and modifications are intended to be within the scope of the invention, as defined by the following claims.

What is claimed is:

1. A thermal storage system for providing time offset cooling to the cooling system of a building or the like, comprising, a tank defining a storage chamber including inlet and outlet ports through which circultes a heat transfer medium, a thermally insulative liner defining a thermal barrier between the interior of said tank and a surrounding environment, a plurality of thermal storage panels substantially filling said tank and located for circulation of said heat transfer medium therebetween, for absorbing heat energy from and transferring heat energy to said heat transfer medium, and flotation means holding said panels bouyantly suspended in a substantilly self-aligning array in said tank.

2. A system according to claim 1, wherein a said panel includes a top flotation member for maintaining the panel in a desired location.

3. A system according to claim 2, wherein a said panel is a substantially rectangular panel having a thickness of less than approximately one inch.

4. A system according to claim 1, wherein a said panel is formed of opposing plies of film material which are joined together at regular intervals along opposed faces.

5. A system according to claim 2, further comprising means for circulating said heat transfer medium between the top and bottom of the tank as it passes from said inlet port to said outlet port.

6. A cold storage system of the type wherein a heat exchange medium circulates through a tank in heat transfer communication with enclosed phase change material, wherein the system includes an array of expandable containers of said phase change material arranged to define a vertically and a horizontally oriented flow path for said medium, said containers being bouyantly mounted in a sufficiently close array such tht a change of phase of said material expands said containers and enlarges one said flow path whiIe at least partially occluding the other flow path.

7. A cold storage system according to claim 6, wherein the phase change material is contained within flat panels defining vertical flow paths between panel walls, said panels being spaced such that freezing of said phase change material at least partially blocks said vertical flow paths.

8. A cold storage system according to claim 6, wherein the phase change material causes the containers to rise and fall, affecting flow along a horizontal flow path below said containers.

9. A system according to claim 6, wherein said containers are suspended for bouyant motion in vertical and horizontal directions in said heat exchange medium.

10. A system according to claim 9, wherein said containers are weighted panels.

11. A system according to claim 10, wherein said panels are quilted.

12. A system according to claim 11, wherein said panels have a thickness under approximately two inches thereby defining a high surface to volume ratio.

13. A system according to claim 12, wherein adjacent panels are spaced apart by a distance of approximately 5–50 percent of the panel thickness.

14. A system according to claim 12, wherein tops of said panels are closed but not sealed.

* * * * *